United States Patent [19]

Bell

[11] 4,306,700

[45] Dec. 22, 1981

[54] LADDER JACK

[76] Inventor: Earl E. Bell, 315 S. 1st, Iola, Kans. 66749

[21] Appl. No.: 130,027

[22] Filed: Mar. 13, 1980

[51] Int. Cl.[3] ..... E04G 5/06

[52] U.S. Cl. ..... 248/238; 182/117; 182/121

[58] Field of Search ..... 182/121, 120, 117; 248/238; 272/144

[56] References Cited

U.S. PATENT DOCUMENTS

| | | | |
|---|---|---|---|
| 524,270 | 8/1894 | Wimbush | 182/120 |
| 1,187,437 | 6/1916 | Lucas | 182/121 |
| 2,151,135 | 3/1939 | Moberg | 182/121 |
| 2,895,660 | 7/1959 | O'Keefe | 182/210 |
| 2,936,989 | 5/1960 | Siek | 182/117 |
| 3,899,045 | 8/1975 | Geisel | 182/121 |

FOREIGN PATENT DOCUMENTS

| | | | |
|---|---|---|---|
| 757427 | 9/1956 | United Kingdom | 182/122 |

*Primary Examiner*—Reinaldo P. Machado

*Attorney, Agent, or Firm*—Schmidt, Johnson, Hovey & Williams

[57] ABSTRACT

In the art of scaffolding, temporarily utilizing elevated planks, stages or platforms for supporting workmen and materials through use of two or more leaning ladders, a compact ladder jack has a tubular, scaffold-supporting arm for storing a suspension chain when not in use. The arm hooks over a ladder rung and the chain is looped over a higher rung. The chain has a snap hook for receiving a preselected chain link to permit mounting of the jack in a position where the arm is disposed horizontally to accommodate variances in ladder inclinations. A latch on the arm guards against accidental displacement of the hook end of the arm from the lower rung.

1 Claim, 12 Drawing Figures

LADDER JACK

Conventionally, ladder jacks are oftentimes bulky, heavy, expensive and not foldable into a relatively compact, light-weight, collapsed unit that is easily carried, transported and stored. Moreover, many common-place jacks cannot be readily and quickly set up or removed from ladders except by exertion of considerable time, energy and skill; in some instances they cannot universally accommodate a particularly wide range of ladder types or inclinations, and the safety factor is not always given full and proper consideration in their manufacture, not only from the standpoint of material strength or fatigue but in regard also to accidental displacement from the ladder, especially when due care is not exercised in attachment and locking into place.

The ladder jack of my present invention employs a strong, tubular, scaffold-supporting arm which has a flat, horizontal upper surface from which the scaffold is not likely to become accidentally displaced. Because the arm hooks over a rung of the ladder it cannot easily be deflected therefrom, but as added precaution, I releasably lock the hook one end of the arm to the rung.

As a means for suspending the free end of the arm from a higher rung, I use a strong link chain capable of supporting all of the weight to which it is likely to be subjected. The chain is bolted to the arm at the outer, open end of the latter such that the chain can be stored inside the arm when not in use, thereby presenting a relatively light weight, neat, compact package which can be carried and stored without difficulty.

The arm is rotatable on its rung and the chain is simply looped over a higher rung such that the effective length of the chain can be predetermined and the arm oriented horizontally as the particular inclination of the ladder requires.

A snap hook on the chain is attached to the proper, preselected chain link between the upper rung and the arm such that the chain cannot possibly become detached during use so as to give rise to damages or injury to the workmen on the scaffolding.

The jack can be easily, quickly and inexpensively manufactured, packaged and shipped without need for skilled workman, special tooling or machined parts. By virtue of using minimum fabrication production is limited essentially to mere assembly.

Mounting on the ladder at high elevations can take place quickly, easily and without need for special skills, tools or assistance. The jack is especially handy for the "do it yourself" layman and equally advantageous when used by professional carpenters, painters, and construction laborers.

Figure 1:
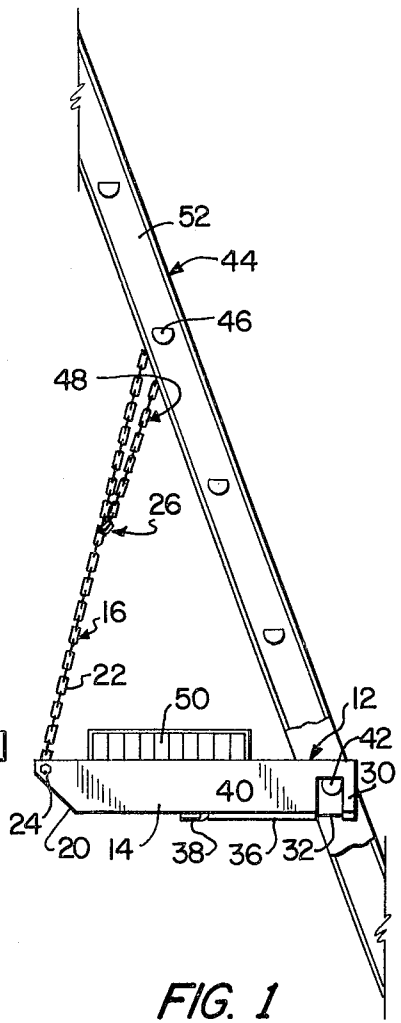
FIG. 1 is a fragmentary, side elevational view of an inclined ladder, parts being broken away for clearness, illustrating one form of ladder jack made pursuant to my present invention with the arm thereof shown supporting a scaffold plank and extending inwardly from the ladder.
Figure 2:
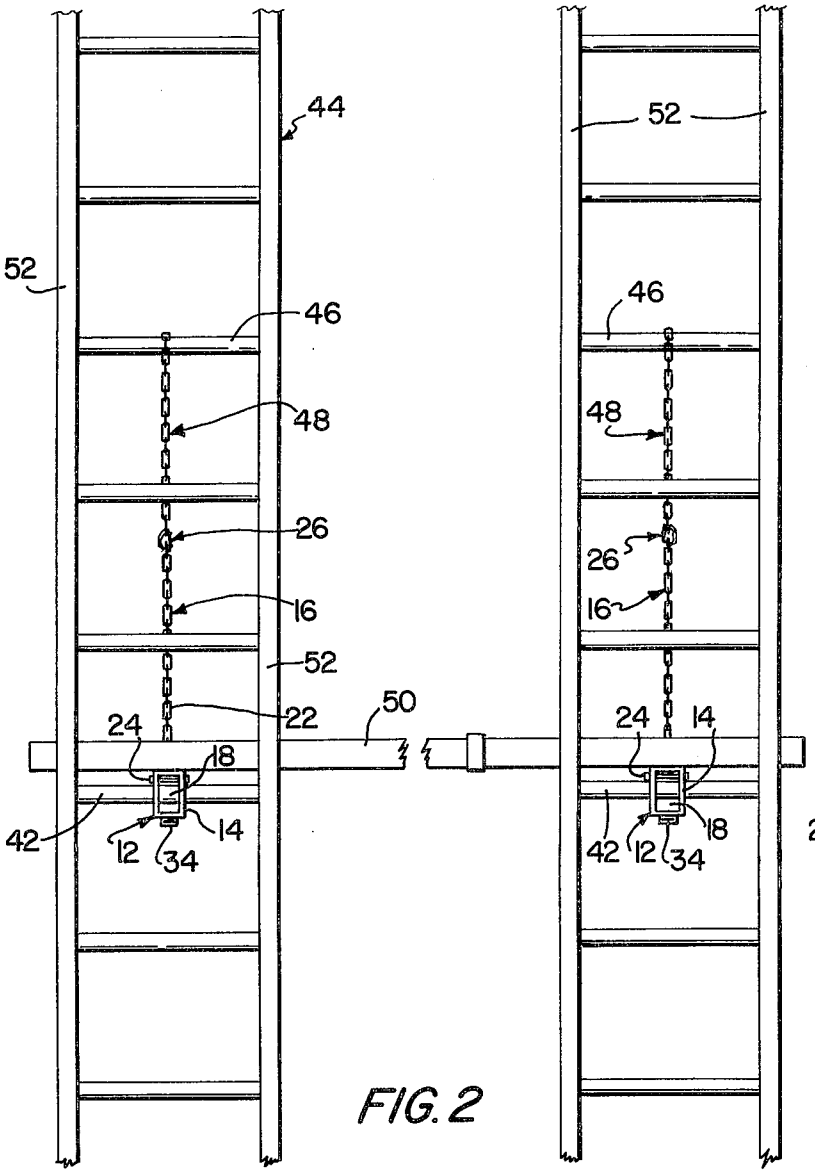
FIG. 2 is a fragmentary, outermost, elevational view of a pair of inclined ladders showing a ladder jack of the kind illustrated in FIG. 1 mounted on each ladder respectively and supporting said platform.

The ladder jack shown in FIGS. 1, 2 and 4–7 of the drawings, designated broadly by the numeral 12, includes an elongated, tubular, scaffol-supporting arm 14 and an elongated, flexible member 16 attached to the arm 14. (It is to be understood at this juncture that two identical ladder jacks 12 are shown in FIG. 2 and that like numerals are used to identify identical parts.) The transversely rectangular arm 14 has a closure 18 at one end thereof and each of its side walls has a taper 20 at the opposite open end of the arm 14.

The member 16 has a series of interconnected chain links 22, one end link **22*a* of which receives a bolt 24 joining the sides of the arm 14 adjacent its top wall and adjacent the tapers 20. The opposite end link 22*b* of the chain 16 connects with a spring snap 26 provided with a hook 26*a* and a leaf spring closure 26*b***.

A keyhold slot 27, centered in the top of the arm 14 above the bolt 24, clears the link **22*a* when the chain 22 is extended upwardly as shown in FIGS. 1 and 2. Each side of the arm 14 has a rectangular, open bottom notch 28 adjacent the closure 18, the notches being aligned, presenting a hook 30 spaced outwardly of the closure 18 and adapted to be closed by an elongated bar latch 32, slidably carried by the bottom wall of the arm 14 therebeneath, and extending into a collar 34 within the hook 30 at its lowermost end. A longitudinally extending tube 36 on the bottom of the arm 14, aligned with the collar 34, reciprocably receives the latch 32, and that end of the latch 32 opposite the collar 34 has an offset 38 exteriorly of the tube 36 mounting a magnet 40 capable of being attracted by and against the metal bottom of the arm 14**.

OPERATION

In use, as shown in FIGS. 1 and 2, the chains 16 are first removed from within the arms 14, wherein they may be stored during non-use; the hooks 30 are then looped over rungs 42 of the inclined ladders 44 (leaning, for example, against the side of a building, not shown); and the latches 32 are then slipped into the collars 34 beneath the the rungs 42 (held in place by the magnets 40), the latches 32 thereby operating to hold the hooks 30 against accidental displacement from the rungs 42.

The chains 16 are then strung over higher rungs 46 to present chain loops 48, whereupon the snaps 26 are connected to links 22, one of which is selected such as to maintain the arms 14 horizontal. Thereupon a workman's platform 50 (which, of itself, may be extensible) is laid horizontally and transversely across the tops of the arms 14, spaced below the rungs 46 and behind the spaced-apart ladders 44.

The effective lengths of the arm-suspending chains 16 between the rungs 46 and the arms 14 is determined by the inclination of the ladders 44 and, as the links 22 are selected for the snaps 26, the arms 14 readily swing up or down to a horizontal position as they rotate at their hooks 30 about the rungs 42 intermediate the ends of the latter between rails 52 of the ladders 44.

The arm **14*a* shown in FIGS. 3 and 8–10 differs from the arm 14 only with respect to the latch means; therefore, with respect to identical parts, the same reference numerals, suitably primed, will be used in connection with those parts of the arm 14*a***.

A latch 32' has an elongated handle 54 terminated at one end thereof in an integral hook 56. A bolt 36' carried by one side wall of the arm **14*a* adjacent closure 18', and passing through the handle 54 adjacent its hook 56, mounts the latch 32' on the arm 14*a* for swinging movement to and from a position closing the lower end of the notch 28' in the side wall of the arm 14*a* on which the latch 32'** is mounted.

Figure 3:
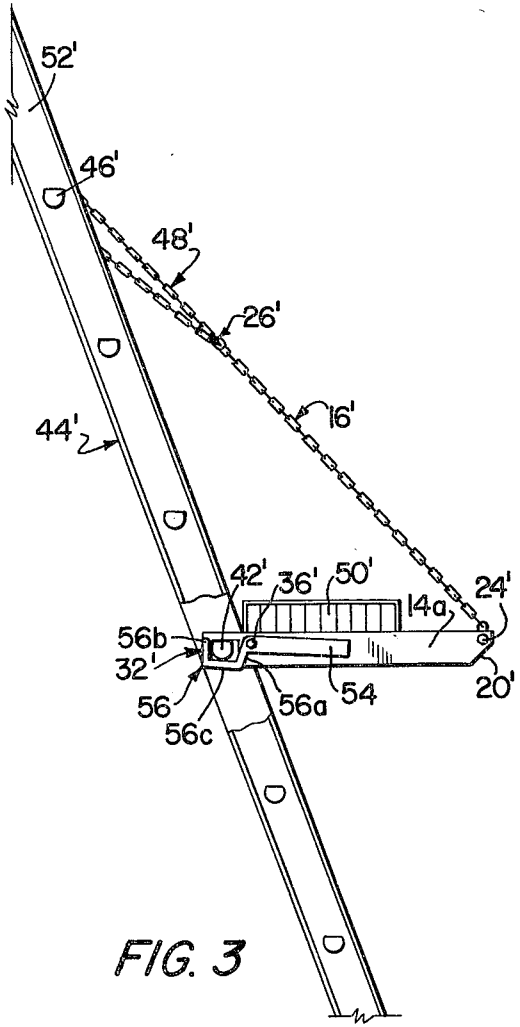
FIG. 3 is a view similar to FIG. 1 but illustrating a modified form of ladder jack and showing the arm thereof extending outwardly from the ladder.
Figure 4:
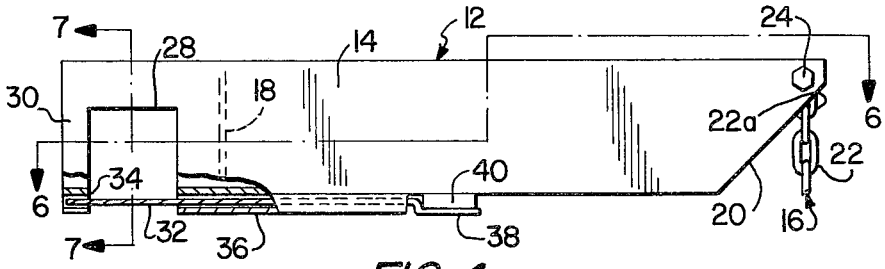
FIG. 4 is an enlarged, fragmentary, side elevational view of the ladder jack shown in FIGS. 1 and 2, parts being broken away and in section to reveal details of construction.
Figure 5:
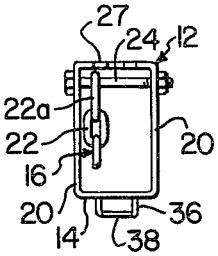
FIG. 5 is a fragmentary view showing one end of the ladder jack illustrated in FIGS. 1, 2 and 4.
Figure 6:
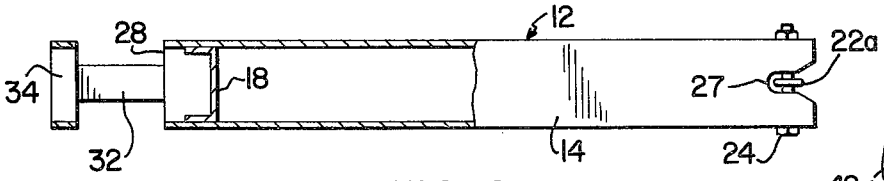
FIG. 6 is a cross-sectional view taken on irregular line 6—6 of FIG. 4.
Figure 7:
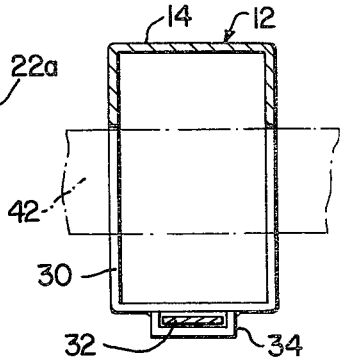
FIG. 7 is a cross-sectional view, still further enlarged, taken on line 7—7 of FIG. 4.
Figure 8:
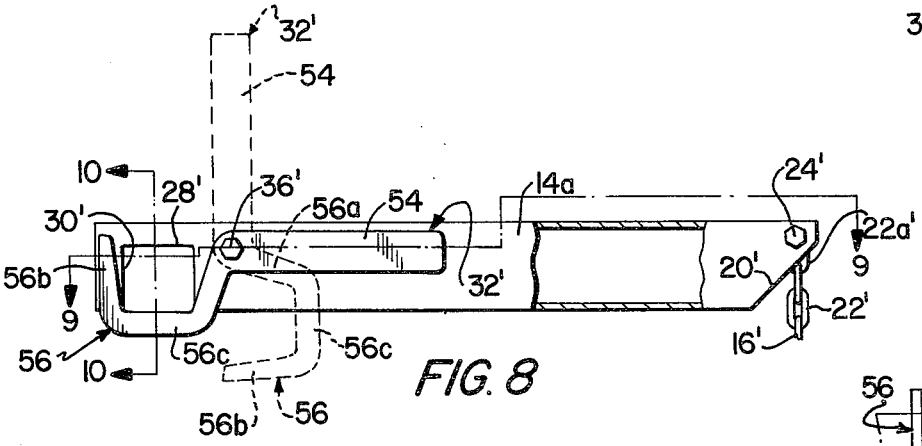
FIG. 8 is a view similar to FIG. 4 illustrating the ladder jack shown in FIG. 3.
Figure 10:
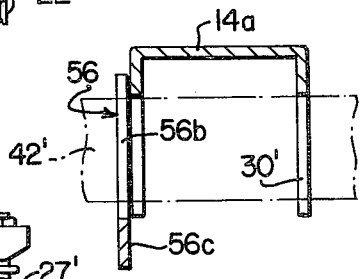
FIG. 10 is a fragmentary, cross-sectional view, still further enlarged, taken on line 10—10 of FIG. 8.
Figure 9:
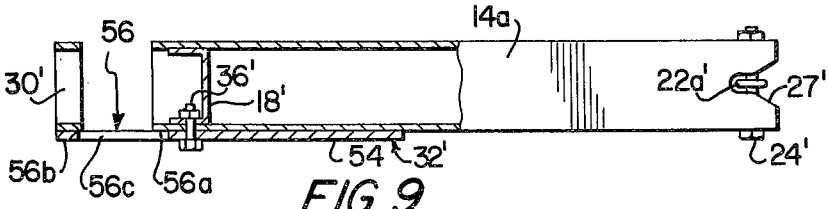
FIG. 9 is a cross-sectional view taken on irregular line 9—9 of FIG. 8.

The hook 56 has a pair of legs **56*a* and 56*b* (the latter of which overlaps the hook 30') and a bight 56*c* which spans the distance across notch 28' beneath rung 42'. When the latch 32' is swung from the dotted line position to the full line position of FIG. 8, the inherent weight of the handle 54 holds the bight 56*c* against the rung 42' therebelow as seen in FIG. 3. In all other respects the use and operation of the arm 14*a* is the same as above explained in connection with the arm 14 and need not be repeated. In FIG. 3, however, the arm 14*a* is shown extended outwardly from the rung 42' to illustrate how both of the arms 14 and 14*a* may be disposed either as shown in FIGS. 1 and 2 or as depicted in FIG. 3**.

Figure 12:
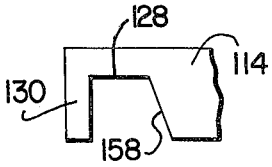
FIG. 12 is a fragmentary side elevational view of a supporting arm having a modified form of rung-receiving notch.
Figure 11:
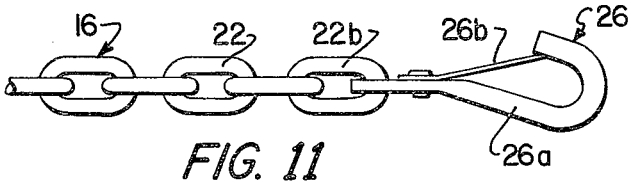
FIG. 11 is an enlarged, fragmentary, side elevational view showing a portion of the suspension chain and its spring snap as used in connection with both forms of the instant invention.

In FIG. 12, an arm 114 has a modified form of notch 128 in each of its sides characterized by inclined edges 158 spaced inwardly from hook 130 such that the widths of the notches 128 progressively decrease as their normally uppermost ends are approached. Therefore, the notches 128 will accomodate rungs 42 of differing diameters and they become wedged in place when the notches 128 are hooked thereover, thereby providing a snug fit to reduce the risk of accidental displacement.

I claim:

1. A ladder jack comprising:

an elongated, tubular, scaffold-supporting arm provided with a top and a pair of spaced apart sides, said sides having a downwardly-opening, U-shaped notch at one end of the arm adapted for looping over a first ladder rung;

support means connected to the opposite end of the arm, extending upwardly from the arm and adapted for connection with a second ladder rung;

a latch for precluding displacement of the notch from said first rung, said latch including an upwardly-facing, U-shaped hook adapted for looping under said first rung and an elongated, normally horizontal handle integral with the hook, said hook including a bight beneath the first rung provided with a pair of spaced, upstanding legs integral therewith and terminating adjacent said top, said handle normally extending from the hook alongside the outer face of one of said sides adjacent said top toward said opposite end of the arm; and a bolt extending through said one side adjacent said notch and said top, and through the handle adjacent one of said legs, said hook being between the bolt and said one end of the arm, said handle being between the bolt and said opposite end of the arm, said bolt pivotally mounting the handle on said arm for upward swinging movement of the handle and downward swinging movement of the hook out of looped relationship to the first rung, the handle being heavier than the hook whereby the latter is normally biased against the first rung, said handle extending vertically from said bolt beyond said top when the latch is swung about the bolt to release the hook from beneath the first rung.

* * * * *